US005806727A

United States Patent [19]

Joseph

[11] Patent Number: 5,806,727

[45] Date of Patent: Sep. 15, 1998

[54] GARMENT HANGERS

[76] Inventor: Marshall Joseph, 1604 Birch Rd., Northbrook, Ill. 60062

[21] Appl. No.: 883,519

[22] Filed: Jun. 26, 1997

Related U.S. Application Data

[62] Division of Ser. No. 618,454, Mar. 14, 1996, Pat. No. 5,649,653.

[51] Int. Cl.[6] ..... A47G 25/14

[52] U.S. Cl. ..... 223/85; 223/92

[58] Field of Search ..... 223/DIG. 4, 85, 223/92, 88; D6/315; 211/113

[56] References Cited

U.S. PATENT DOCUMENTS

| | | |
|---|---|---|
| D. 32,777 | 6/1900 | Annis . |
| D. 76,341 | 9/1928 | Campbell . |
| D. 181,917 | 1/1958 | Tupper . |
| D. 193,746 | 10/1962 | Cohen . |
| D. 205,567 | 8/1966 | Chambers . |
| D. 270,978 | 10/1983 | Guebert et al. . |
| D. 279,236 | 6/1985 | Kupchik . |
| 964,003 | 7/1910 | Douglas . |
| 2,164,420 | 7/1939 | Petty . |
| 2,476,730 | 7/1949 | Hess . |
| 2,524,612 | 10/1950 | Vineyard . |
| 2,872,090 | 2/1959 | Goodman . |
| 2,940,648 | 6/1960 | Martin . |
| 3,443,729 | 5/1969 | Hannum . |
| 3,485,453 | 12/1969 | Wagar et al. . |
| 4,624,396 | 11/1986 | Universe . |
| 4,997,114 | 3/1991 | Petrou . |
| 5,071,045 | 12/1991 | Hollis . |
| 5,078,307 | 1/1992 | Suddath . |

FOREIGN PATENT DOCUMENTS

| | | |
|---|---|---|
| 3204293 | 8/1983 | Germany . |

*Primary Examiner*—Bibhu Mohanty
*Attorney, Agent, or Firm*—Olson & Hierl, Ltd.

[57] ABSTRACT

An improved unitary garment hangers is provided wherein an angular leg extension of a central hanger support structure, such as a hook, cooperates with, and connects to, the apex connection between upper ends of hanger shoulder supports. The perimeter distance along one shoulder support from the outer end thereof to the angular leg extension is substantially greater than the corresponding distance for the other shoulder support. This shoulder length differential is achieved either by the support angular leg extension or by a combination of this extension with a terminally adjacent upper portion of one shoulder support. Such a garment hanger permits both rapid and easy inserting or removing of the hanger through a garment neck region without stretching or tearing of the garment, and inserting or removing the hanger from underneath the garment.

24 Claims, 6 Drawing Sheets

GARMENT HANGERS

This application is division, of application Ser. No. 08/618,454, filed Mar. 14, 1996, now U.S. Pat. No. 5,649, 653.

FIELD OF THE INVENTION

This invention relates to garment hangers, particularly hangers for garments having small collar or neck openings.

BACKGROUND OF THE INVENTION

A wire clothes hanger for a garment having "a comparatively small neck" is disclosed in Petty U.S. Pat. No. 2,164,420. However, the Petty '420 hanger requires an integrally associated garment retaining means to hold the garment on the hanger.

Wagar et al. U.S. Pat. No. 3,485,423 discloses a wire hanger potentially usable for clothes having small neck openings. The lower end of one hanger shoulder support is joined by a continuous wire to the upper end of the other shoulder support. However, the Wagar et al. '423 hanger has geometric restrictions and is relatively inconvenient and cumbersome to use.

There is a need for a new and improved clothes hanger which is adapted for use with small necked garments and which overcomes and avoids such prior art problems. The present invention satisfies this need.

SUMMARY OF THE INVENTION

This invention is directed to a new and very useful improved garment hanger particularly adapted for use with clothes having small neck openings and to an associated improved method of hanging garments made possible by the inventive hanger.

The inventive hanger includes a hanger support structure, such as a hook or the like, having an elongated connecting leg extension. The leg extension angularly extends between the support structure and the interconnection location of the joined upper ends of the two opposed arm supports of the hanger. Preferably, this angular leg extension is approximately coplanar with the arm supports.

In one embodiment, the upper ends of the two hanger arms have respective upper ends which join with the lower end of the connecting leg extension medially relative to the hanger.

In another embodiment, the upper ends of the two hanger arms join with the lower end of the connecting leg extension off-center relative to the hanger. An inwardly (relative to the hanger) extending loop or inset is provided in one arm at a location that is adjacent both to the jointing location and to the angular leg extension.

In both embodiments, one arm effectively has a greater unobstructed perimeter distance than the other. This greater effective perimeter distance of one arm permits that arm to be inserted through a garment neck and then advanced along and over that arm to a location where the other arm can be slipped through the neck.

Particularly in the case of a garment having a neck opening of relatively small diameter, the inventive hanger avoids and prevents damage to the garment neck region, as evidenced by stretched fabric, broken threads, tearing or the like.

The inventive hanger makes possible a new and useful method for mounting a garment upon the hanger, or for removing a garment from the hanger, especially a garment having a small (or narrow) neck (or collar) aperture.

The mounting method involves progressive, sequential steps. One first inserts the outer end of the effectively longer one of the two hanger arms into and through the garment neck opening. The inserting movement is continued until a lower portion of the angular leg extension is adjacent to or even beyond the perimeter region of the garment neck. At this location, the other and effectively shorter hanger arm is passed through the garment neck by tilting the hanger relative to the garment neck. Then, the hanger is oriented relative to the garment so that each hanger arm is engaged with a different but adjacent respective under surface portion of one shoulder region of the garment while the angular leg extension projects through the neck, thereby completing the mounting operation.

For removing a garment from the hanger, the method step procedure is reversed.

The method can be practiced with heavy garments, such as coats or jackets or the like. The method also reduces hand and wrist stress.

The inventive hanger and the method of use are also desirable for use by employees of restaurants, cleaning establishments, stores and the like who frequently mount and remove garments from conventional hangers and who are thus exposed to the repeated hand stress associated with conventional prior art hanger usage.

The method can be practiced, if desired, without removing the inventive hanger from a rod or hook. Also, the method can be practiced, if desired, by initially laying the garment to be hung upon a flat surface, such as a bed before inserting the inventive hanger into the garment. This mode of practice is advantageous for use by handicapped persons, such as arthritic or one-handed persons.

Nothing in the prior art discloses a hanger structure wherein the hanger support structure and the hanger arms are so interrelated with an angular leg extension of the hanger support structure that the perimeter distance along one hanger arm is effectively lengthened while still achieving a common interconnection location between upper respective ends of the two shoulder supports and the lower end of an angular leg extension. The hanger arm length differential makes possible both the accommodation of the hanger in a garment small neck perimeter during hanger inserting or removing without stretching or tearing of the garment as well as the removal of the hanger from the bottom of a garment without time restriction of inserting and removing the hanger from the bottom of the garment.

The unique hanger arm effective length differential, and the unique hanger support and hanger arm interrelationship that are achieved in the hanger of this invention allows a fast, effective, reliable safe way to hang a garment and to mount and remove the inventive hanger from a garment, particularly a narrow neck garment.

The inventive hanger is simple, rugged and not prone to damage in handling or use.

The inventive hanger is economical to fabricate and manufacture and can be made with various materials and various production processes. The hanger can be made in various configurations and sizes.

Other and further objects, aims, purposes, features, advantages, embodiments, applications and the like will be apparent to those skilled in the art from the present specification taken with the accompanying drawings and the appended claims.

DETAILED DESCRIPTION

Figure 2:
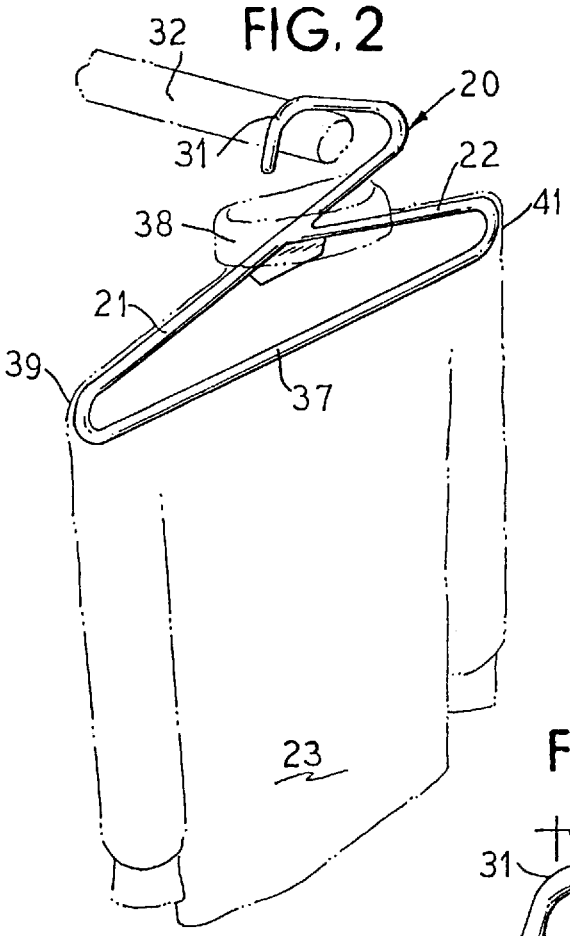
FIG. 2 is a perspective environmental view showing the hanger of FIG. 1 engaged with a closet rod and with a garment, the rod and the garment being shown in phantom.
Figure 3:
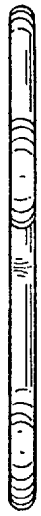
FIG. 3 is an end elevational view of the hanger of FIG. 1 taken from the right end of FIG. 1.
Figure 4:
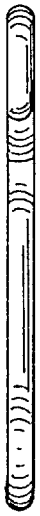
FIG. 4 is an end elevational view of the hanger of FIG. 1 taken from the left end of FIG. 1.

Referring to FIGS. 1–8D, there is seen one presently preferred embodiment 20 of a garment hanger of this invention. Hanger 20 incorporates two elongated arms 21 and 22, each arm 21 and 22 being adapted for supporting a different opposed shoulder region 39 and 41 of an illustrative garment 23, such as shown in FIG. 2. Each arm 21 and 22 has an outer end 24 and 26, respectively, and an inner end 27 and 28, respectively. Each arm 21 and 22 generally oppositely and downwardly extends relative to the other and relative to their respective inner ends 27 and 28 which latter meet and join one another at a mid-region apex location 29. Preferably, each arm 21 and 22 is about equal to the other in length in hanger 20.

Optionally but preferably in the hanger 20, the outer ends 24 and 26 (which are indefinite in location) are interconnected by an elongated cross member 37. The locations of such interconnections are preferably (and as shown) curved to avoid catching or snagging any contacting portion of a garment 23 or the like.

Figure 1:
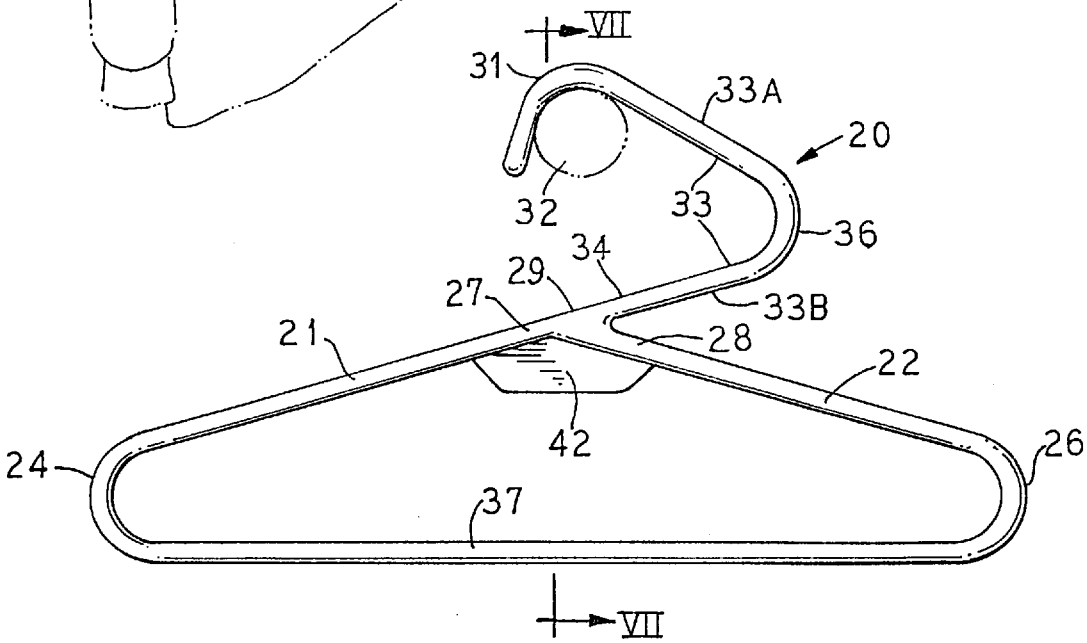
FIG. 1 is a side elevational view of one embodiment of a garment hanger of this invention showing in phantom a closet rod in association therewith.
Figure 5:
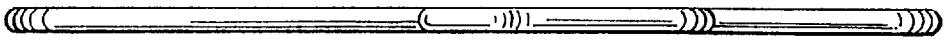
FIG. 5 is a top plan view of the hanger of FIG. 1.
Figure 6:
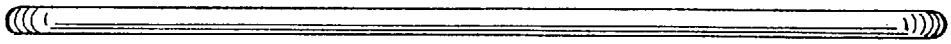
FIG. 6 is a bottom plan view of the hanger of FIG. 1.
Figure 7:
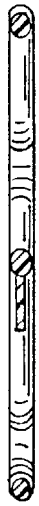
FIG. 7 is a vertical sectional view taken along the line VII—VII of FIG. 1.
Figure 8A:
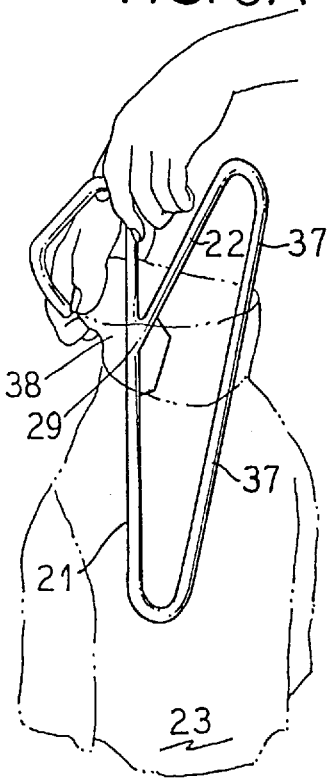
FIGS. 8A through 8D illustrate progressive steps in a method for mounting a garment upon the hanger of FIG. 1.
Figure 8B:
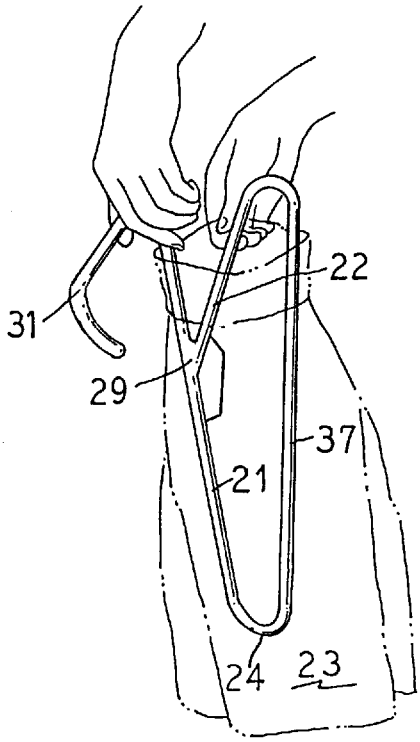
Figure 8C:
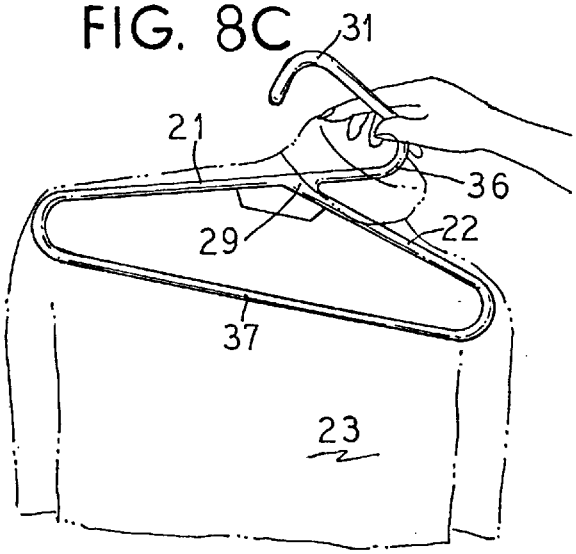
Figure 8D:
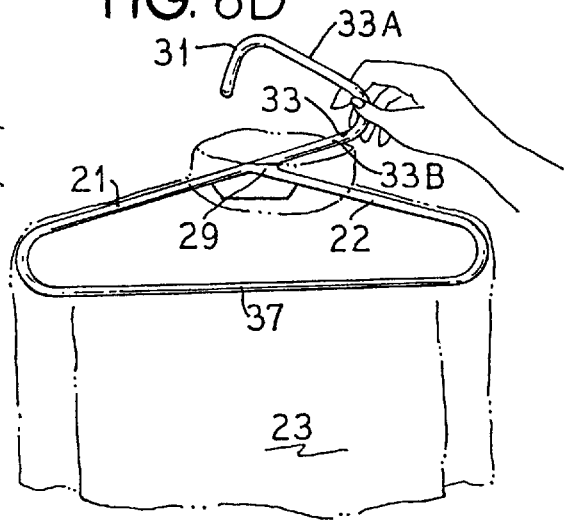

The hanger 20 incorporates a suspending means, which is here illustratively a hook 31, for hanging the arms 21 and 22 from a superior (i.e., overlying) location, such as a closet rod 32 as shown in FIG. 1 and 2, or the like. When so hung, the relationship between the hook 31 and the arms 21 and 22 is such that the arms 21 and 22 are (as shown in FIG. 2) in a generally symmetrical, balanced relationship relative to one another and to the mid-region apex location 29. The suspending means has an associated depending elongated connecting leg 33 whose lower end 34 terminates at, and joins to, the apex location 29.

The elongated leg 33 includes an approximate medial angled knee 36 located between an upper leg portion 33A and a lower leg portion 33B. The angled knee 36 is thus located generally in a mid-region of the leg 33 while the lower leg portion 33B extends between the knee 36 and the lower end 34. The term "medial" and the term "mid-region of the leg 33" indicate that the knee 36 can be located at almost any position along the leg 33 between the suspending means (preferably a hook) and the lower end 34; however, and as shown, the knee 36 is preferably approximately centrally located along the leg 33. The upper end of the upper leg portion 33A is indefinite but is preferably interconnected with (and integral with) hook 31 in hanger 20. The upper leg portion 33A and the lower leg portion 33B each preferably have a generally independently inclined spatial orientation. The lower leg portion 33B in effect defines an extension of one of the arms 21 and 22, here illustratively arm 21, commencing at the apex location 29. As a result, an unobstructed perimeter distance extends along arm 21 from the outer end 24 first along arm 21 and then along lower leg portion 33B to a location that is substantially past the apex location 29 and that approaches the knee 36. Thus, when the arm 21 is inserted into the neck region 38 of garment 23, such as illustrated, for example, in FIG. 8A, the arm 21 is advanceable through the neck region 37 past the apex location 29 until the neck region 37 is in adjacent relationship to the lower leg portion 33B (see FIG. 8B).

Preferably, in the hanger 20, the combination of the arms 21 and 22, the hook 31, the leg 33, and the cross member 33 have a flat or planar configuration when viewed in top plan or end elevation.

Referring to FIGS. 9–16D, there is seen another embodiment 45 of a hanger of this invention. Hanger 45 incorporates two elongated arms 46 and 47, each arm 46 and 47 being adapted for supporting a different opposed shoulder region 48 and 49 of an illustrative garment 51, such as exemplarily shown in FIG. 10. Each arm 46 and 47 has an outer end 52 and 53, respectively, and an inner end 54 and 56, respectively. Each arm 46 and 47 generally oppositely and downwardly extends relative to the other and relative to a hanger mid-region 57 (when the hanger 45 is viewed in side elevation). The respective inner ends 54 and 56 meet and join one another at an apex location 58 which is off-center relative to the mid-region 57 (when the hanger 45 is viewed in side elevation).

Arm 46 in the region thereof adjacent to the apex location 58 has defined therein along its length a generally J-configured inset 59.. Preferably the J-configured inset 59 is generally coplanar with arm 46. When taken along outside edge portions (relative to hanger 45) from end 52 to about apex location 58, the arm 46 has a greater length than the arm 47.

Optionally but preferably in the hanger 45, the outer ends 52 and 53 (which are indefinite in location) are interconnected together by an elongated cross member 61. The locations of such interconnections are preferably (and as shown) curved to avoid catching or snagging any contacting portion of a garment 51 or the like.

Figure 10:
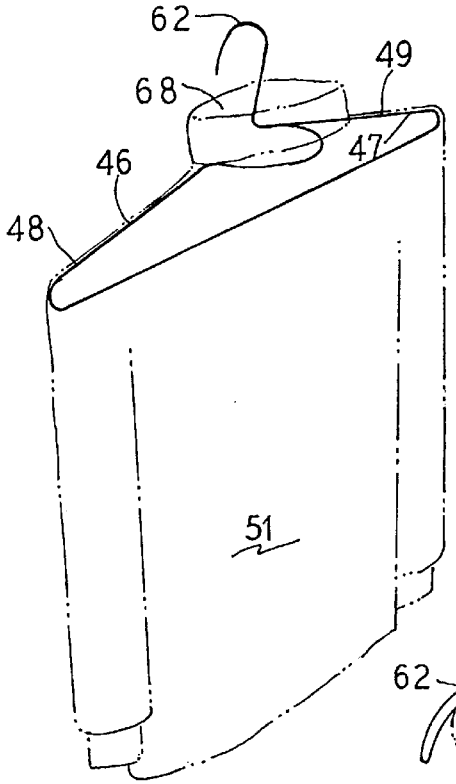
FIG. 10 is a perspective environmental view showing the hanger of FIG. 9 engaged with a garment, the garment being shown in phantom.
Figure 11:
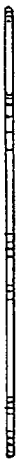
FIG. 11 is a end elevational view of the hanger of FIG. 9 taken from the right end of FIG. 9.
Figure 12:
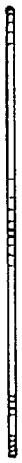
FIG. 12 is an end elevational view of the hanger of FIG. 9 taken from the left end of FIG. 9.
Figure 9:
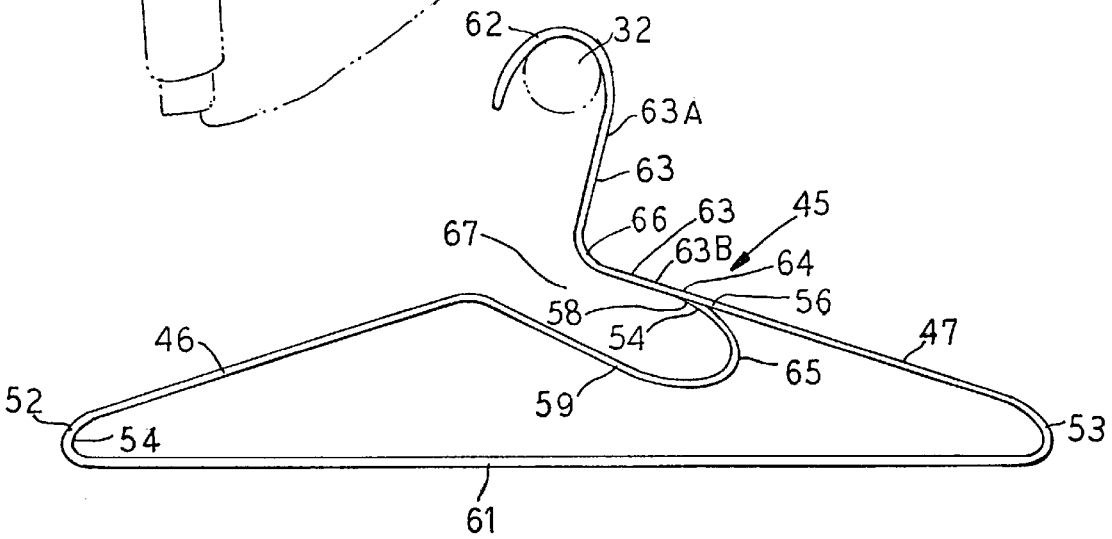
FIG. 9 is a side elevational view of another embodiment of a garment hanger of this invention showing in phantom a closet rod in association therewith.
Figure 13:
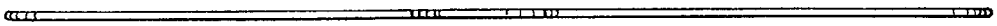
FIG. 13 is a top plan view of the hanger of FIG. 9.
Figure 15:
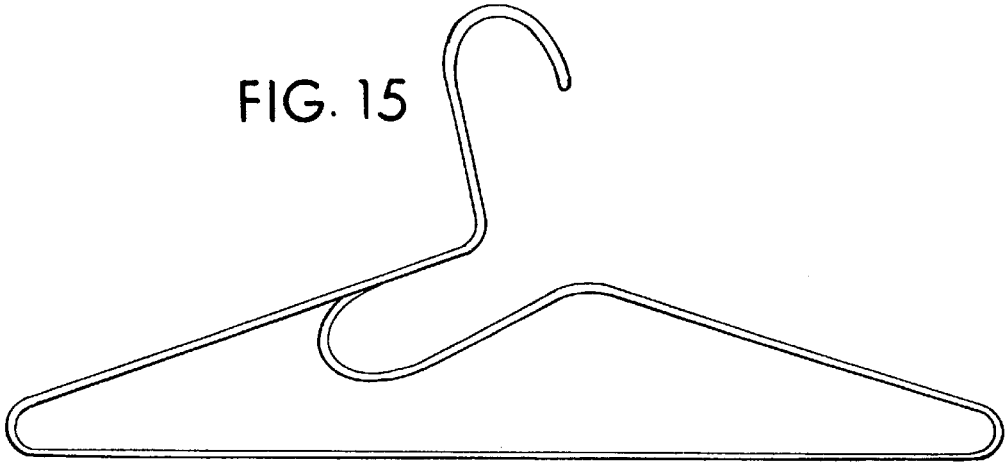
FIG. 15 is an opposite side elevational view of the hanger of FIG. 9.
Figure 14:
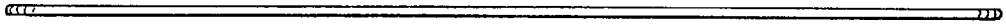
FIG. 14 is a bottom plan view of the hanger of FIG. 9.

The hanger 45 incorporates a suspending means, which is here illustratively a hook 62, for hanging the arms 46 and 47 from a superior (i.e., overlying) location, such as a closet rod 32 or the like. When so hung, the relationship between the hook 62 and the arms 46 and 47 is such that the arms 46 and 47 are (as shown in FIG. 10) in a generally symmetrical, balanced relationship relative to one another and to the mid-region 57. The hook 62 has an associated depending elongated connecting leg 63 whose lower end 64 terminates at, and joins to, the apex location 58.

The elongated leg 63 includes a medial angled knee 66 located between an upper leg portion 63A and a lower leg portion 63B, the latter extending between the knee 66 and the lower end 64. The upper end of upper leg portion 63A merges into hook 62. The upper leg portion 63A and the lower leg 63B each preferably have a generally independently inclined spatial orientation. The lower leg portion 63B in effect defines an extension of the arm 47 commencing at the apex location 58. The lower leg 63B, the apex location 58, and the J-configured inset 59 cooperate to define a laterally, and preferably also downwardly extending, intrusion 67 into the hanger 45. Intrusion 67 extends below and past the knee 66 relative to arm 46 to a throat bottom 65. Preferably, knee 66 is coplanar with the lower leg 63B and the J-configured inset. As a result, an unobstructed perimeter distance extends along arm 46 from the outer end 52 of arm 46 and along the J-configured inset 59. This distance extends substantially past the mid-region 57 and even preferably (and as shown) somewhat beyond the apex location 58.

Figure 16A:
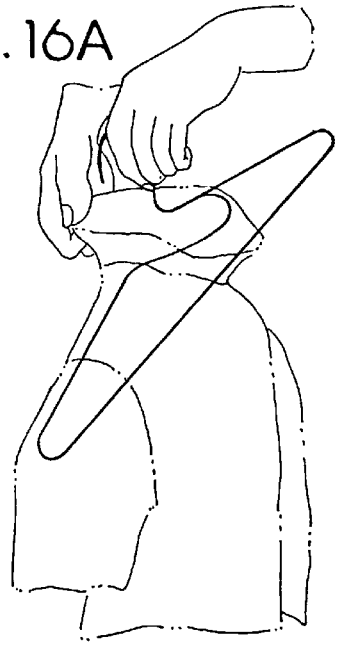
FIG. 16A through 16D illustrate progressive steps in a method for mounting a garment upon the hanger of FIG. 9.
Figure 16B:
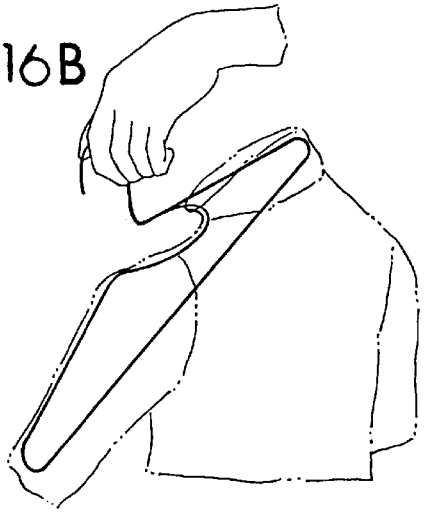
Figure 16C:
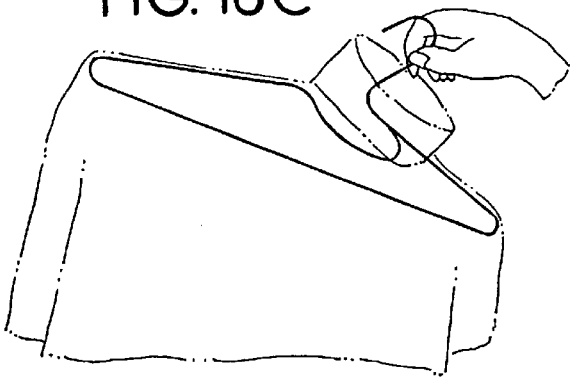
Figure 16D:
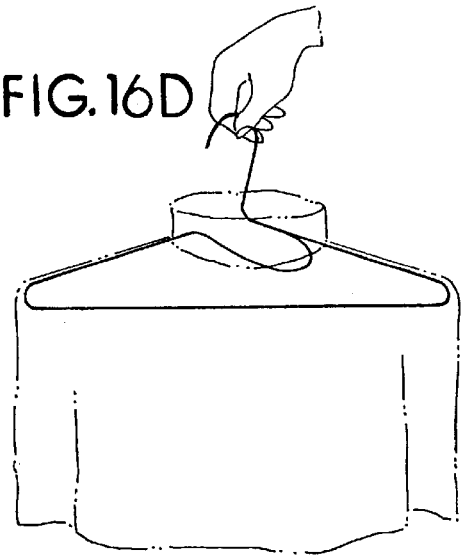

The intrusion 67 provides a receiving channel for receiving thereinto the neck region 68 of an (illustrative) garment 51. Thus, when the arm 46 is inserted into the neck region 68 of garment 51 in the manner illustrated, for example, in FIGS. 16A and 16B, the arm 46 is advanceable through the neck region 68 past the mid-region 57 and into the intrusion 67 until the neck region 68 is at least in adjacent relationship to the lower leg portion 33B. Optionally, the neck region 68 can be moved beyond the lower leg portion 33B into the cup-shaped region defined by the lower portion of the J-configured inset, such as illustrated in FIG. 16B.

Preferably, in the hanger 45, the combination of the arms 46 and 47, the hook 62, the leg 63 and the cross member 61 have a flat or planar configuration when viewed in top plan or end elevation.

A hanger of this invention, such as hanger 20 or hanger 45, can be constructed of various conventional materials using various conventional construction methods. For example, a hanger can be comprised of molded plastic, and cross-sectionally the plastic can be tubular. In, for example, an apex location 29 in hanger 20, a slight joint enlargement in the plastic can be provided (as shown), and also a reinforcing brace plate 42 can be included, if desired. Plastic tubing or rodding used in a hanger can be preformed, if desired.

For another example, a hanger can be comprised of a preformed metal wire, length with a weldment (not detailed) being provided for example at an apex location 58 in hanger 45. The wire can be comprised of steel, a ferrous alloy, aluminum, or the like and can have various thicknesses (or gauges). Alternatively, the wire can be spirally twisted (not detailed) in the apex location 58. The so formed hanger can then be plated, anodized, painted, coated with an elastomeric plastic, or the like, if desired.

Hangers can be variously otherwise formed using, for example, preformed plastic rodding, plastic extrusions, plastic coated wire, plastic tubing, metal tubing mixtures thereof or the like, as desired by a fabricator, and various working and forming procedures can be used to fabricate a single hanger, such as compression or laser cutting, heat forming, etc.

Known methods of adding "frictionizers" to hanger surfaces can be utilized, so as to provide a non-slipping or slip retarding feature to deter a garment from slipping off or dislodging from a hanger of the invention. A consumer can add, if desired, non-slip strips to exterior hanger shoulder surfaces or the like.

A hanger of this invention, such as a hanger 20 or hanger 45, makes possible new and very useful methods for mounting or removing a garment, especially a garment with a small diameter neck, from an inventive hanger. Thus, in one method for mounting, such a hanger is oriented generally perpendicularly relative to the longitudinal medial axis of the garment to be hung. The process step sequence is illustrated in FIGS. 8A–8D for hanger 20 and in FIGS. 16A–16D for hanger 45.

In this method, the outer end of the hanger arm having the greatest unobstructed perimeter distance therealong, such as the outer end 24 of arm 21 of hanger 20, or the outer end 52 of arm 46 of hanger 45, is inserted through the garment neck region and into the garment, such as the neck region 38 of garment 23 or the neck region 68 of the garment 51, until the neck region is located at least approximately adjacent to the lower leg portion of the hanger, such as the lower leg 33B of the hanger 20 or the lower leg 63B of the hanger 45 (see FIGS. 8 and 16).

Next, the hanger is tilted laterally relative to the garment while the outer end of the remaining arm, such as the outer end 26 of the arm 22 of hanger 20, or the outer end 53 of the arm 47 of hanger 45, is slipped through the garment neck region. At this point in the method, both arms of the hanger are in the garment while the suspending means (that is, the hook 31 of hanger 20 or the hook 62 of the hanger 45) remains outside but adjacent to the garment neck.

Thereafter, the hanger is oriented relative to the garment so that each one of the hanger arms is interiorly (relative to the garment) adjacent to a different respective one of the shoulder regions of the garment (such as shoulder regions 39 and 41 of hanger 20 or shoulder regions 48 and 49 of hanger 45). When the hanger is then hung from its suspending means, the garment hangs from the hanger.

Figure 20A:
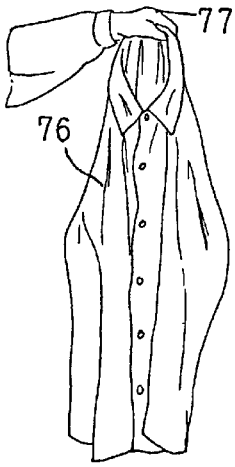
FIGS. 20A–20F illustrate progressive steps in a method for mounting a garment upon the hanger of FIG. 1.
Figure 20B:
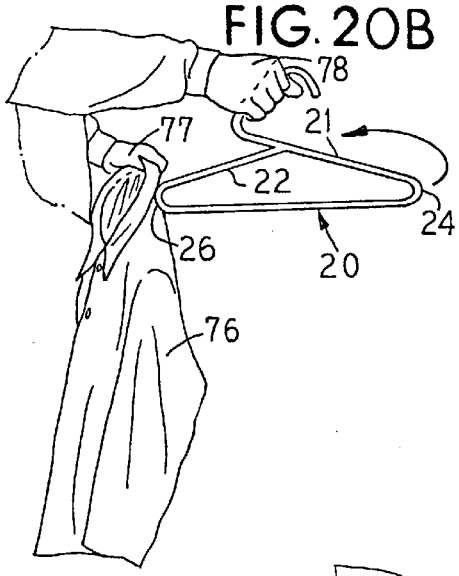

Another and more preferred method for mounting is illustrated by hanger 20 in FIGS. 20A–20F. In this method, as shown in FIGS. 20A and 20B, the hanger 20 is initially oriented generally horizontally relative the garment 76 which is being hung, this garment 76 being conveniently suspended with its longitudinal medial axis extending vertically. The back of the garment 76 neck is held by the left hand 77 while the upper leg 33A of hanger 20 is grasped by the fingers of the right hand 78 adjacent. In FIG. 20B, the hanger 20 happens to have been grasped in the orientation shown in FIG. 20B; hanger 20 of course could have been grasped in other orientations.

Figure 20C:
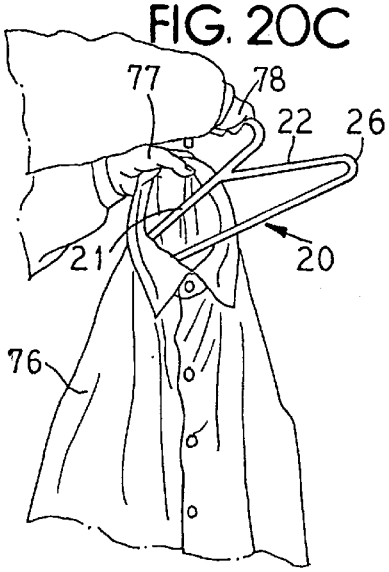

Hanger 20 in FIG. 20C is turned through about 180° with the right hand 78 (as shown in FIG. 20C) and tilted somewhat from the horizontal position shown in FIG. 20B and the outer end 24 of arm 21 is inserted into the neck opening of garment 76.

Figure 20D:
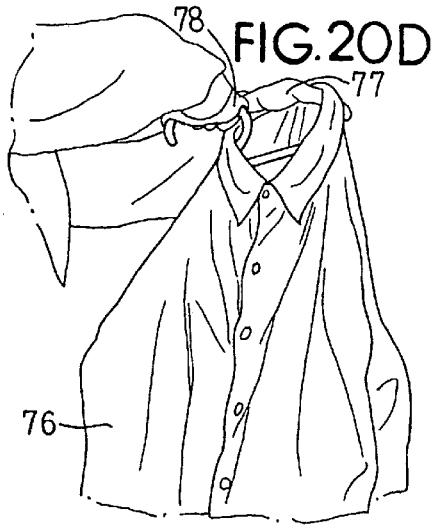

The insertion process continues, as shown in FIG. 20D until the outer end 26 of arm 22 clears the neck opening and passes into the garment 76. At the point of clearance, the end 26 is upwardly tilted, and thereafter is lowered to permit the garment 76 to conform to the arm 22.

Figure 20E:
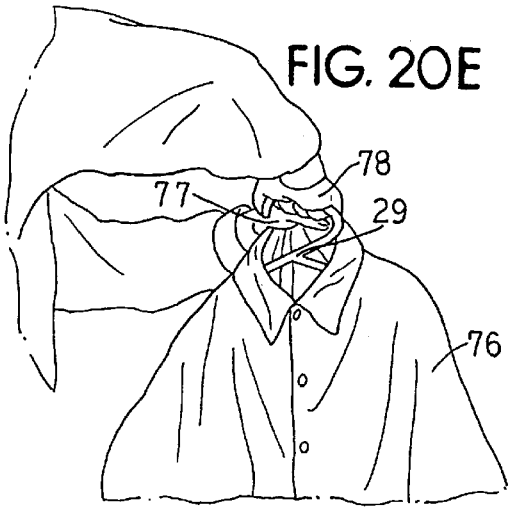
Figure 20F:
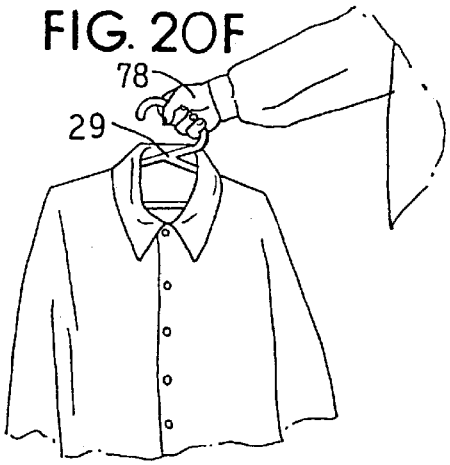

As shown in FIG. 20E, the hanger 20 is shifted laterally relative to the garment 76 so that the apex location 29 is positioned in the approximate center of the garment 76 neck opening. This shifting is comparable to a smooth pendulum-type rhythmic motion and is typically completely quickly in a very short time interval, as shown in FIG. 20F. During the mounting procedure, upper leg 33A continues to be held by the right hand 78.

The exact technique for mounting a garment upon an inventive hanger may vary from person to person, as those skilled in the art will readily appreciate.

Figure 21:
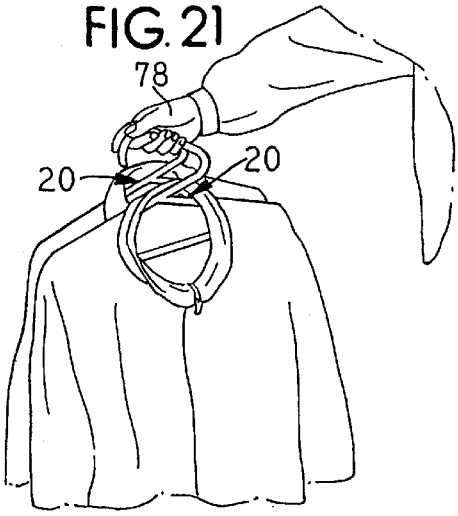
FIG. 21 illustrates how two or more garments each mounted on a hanger of FIG. 1 can be comfortably carried in one hand.

One feature that is particularly associated with the inventive hanger 20 is illustrated in FIG. 21 where the right hand 78 is holding two hangers 20 each with a different mounted garment by grasping together the upper leg 33A of both hangers within the fingers. One hanger 20 that is heavily loaded, or two or more hangers 20 that are each garment mounted, can be comfortably carried by so grasping with a sole hand.

Figure 17:
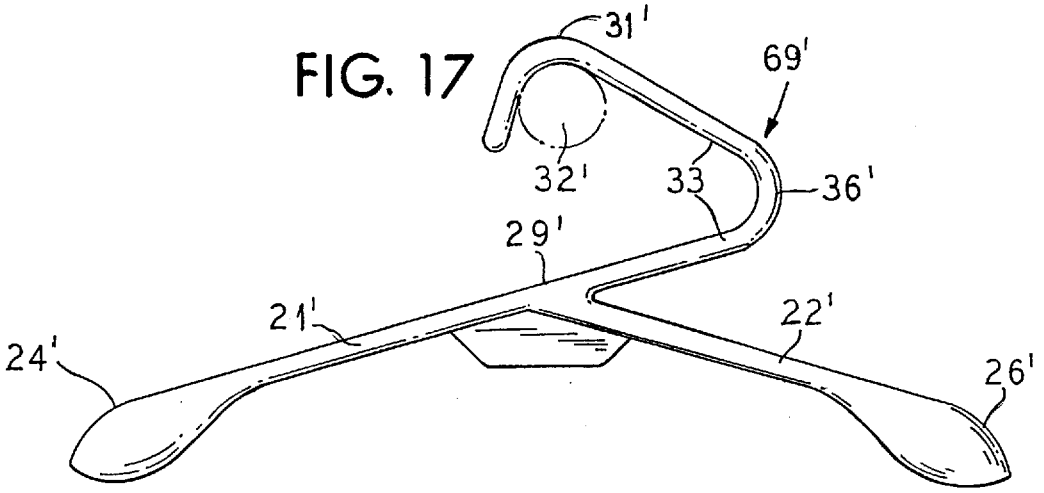
FIG. 17 is a side elevational view of an alternative embodiment of a garment hanger of this invention.

Shown in FIG. 17 is an alternative embodiment 69 of a garment hanger of this invention which is similar to hanger 20. Corresponding components are similarly numbered but with the addition thereto of prime marks for identification purposes. In hanger 69, each arm 21' and 22' is thickened and each outer end 24' and 26' is enlarged, thereby to better distribute the weight of a garment mounted thereon.

Figure 18:
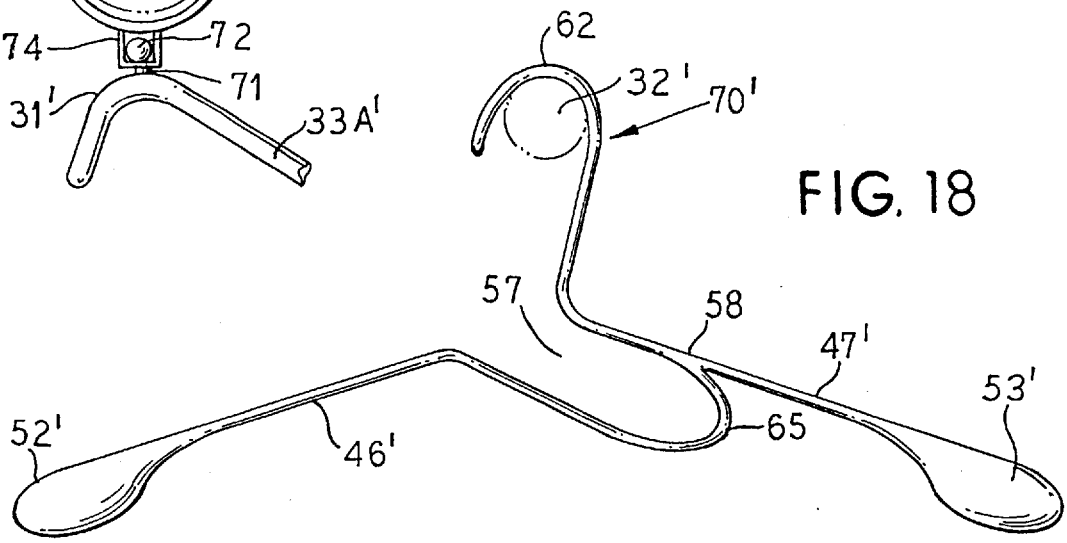
FIG. 18 is a side elevational view of another alternative embodiment of a garment hanger of this invention.

Shown in FIG. 18 is an alternative embodiment 70 of a garment hanger of this invention which is similar to hanger 45. In hanger 70, each outer end 52 and 53 is thickened for garment weight distribution purposes. Corresponding components are similarly numbered as in hanger 45 but with the addition thereto of prime marks for identification purposes.

In hangers 69 and 70, a cross member is eliminated.

Figure 19:
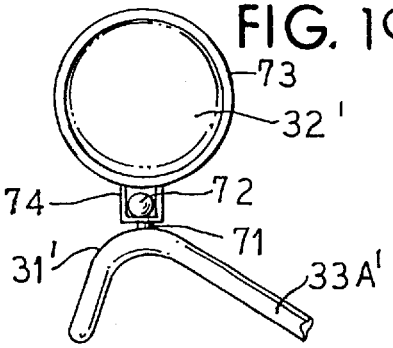
FIG. 19 is a fragmentary view of the upper portion of the garment hanger of FIG. 1, but showing the hanger with an alternative hanger suspending means, here a ring structure, a closet rod being shown in phantom in association therewith.

In FIG. 19, an alternative suspending means is fragmentarily shown for a hanger 20. Thus, an uppermost portion associated is provided with an associated upwardly projecting stud 71 which terminates in a spherical head 72 a ring 73 is provided with an associated peripheral outstanding U-shaped bracket 74 which has in its base a receiving slot for stud 71. Once the stud 71 is in the slot, then the entering end of the slot is compressed into a closed configuration which retains the association between stud 71 and bracket 74 while preferably maintaining a generally pivotable relationship between head 72 and bracket 74. The ring 73 is slidably engagable with closet rod 32'.

From the preceding disclosure, one will appreciate that, in a hanger of this invention, characteristically the distance between the knee 36 and the outer end 26 of arm 22 in hanger 20, and the comparable distance between the throat bottom 65 and the outer end 53 of arm 47 in hanger 45, is equal to or less than about one-half the circumferential distance of a collar of a garment which is to be hung from such a hanger 20 or 45. The knee 36 is comparable to the throat bottom 65. This distance comprises the insertion distance that is used in a hanger 8 this invention when hanging a garment, particularly a garment with a relatively neck opening, upon such hanger. Typically in the prior art, there is insufficient distance from either hanger end to the medial region of the hanger where the hook bottom is affixed to achieve an insertion distance comparable to that achieved in the present inventive hangers.

Other and further embodiments and variations will be apparent to those skilled in the art from the present teachings. The invention is not limited to the present illustrative embodiments. Changes therein can be made without departing from the spirit and scope of the invention.

What is claimed is:

1. An improved garment hanger comprising:

two elongated arm means, each one for supporting a different opposed shoulder of a garment, each one having an outer end and an inner end, each one generally oppositely and downwardly extending relative to one another and to a mid-region therebetween, each said inner end meeting the other at an apex location which is offset from said mid-region when viewed in side elevation;

suspending means for hanging said arm means from a common superior location so that said arm means are in a generally symmetrical, balanced relationship relative to one another and to said mid-region, said suspending means having an associated depending elongated connecting leg whose lower end terminates at said apex location;

connecting means for joining together both said inner ends and said lower end at said apex location; and said elongated connecting leg having a medial angled knee and a lower leg portion that extends between said knee and said lower end, said knee being spaced from said apex location, said lower leg portion having an inclined orientation such that said lower leg portion defines an extension of one of said arm means commencing at, and extending from, said apex location to a location that is substantially at said knee said one arm means having defined therein in the region thereof adjacent to said apex location a generally J-configured length which is generally coplanar therewith and with said lower leg portion, thereby providing in cooperation with said lower leg portion and said apex location a laterally extending open intrusion that extends below said angled knee generally coplanarly;

the relationship between, and the respective configurations of, said one arm means, said lower leg portion, said apex region, and said intrusion being such that, when said one arm means is inserted into the neck region of a necked garment, said one arm means and said intrusion are slidably advanceable into said neck region until said neck region is located substantially beyond said mid-region with said neck region being in adjacent relationship to a region of said lower leg portion and also to said knee.

2. The garment hanger of claim 1 wherein each of said arm means is about equal to the other in length, said apex location is about at a said mid-region when said hanger is viewed in side elevation.

3. The garment hanger of claim 1 which is generally planar in spatial configuration.

4. The garment hanger of claim 3 wherein the said respective outer ends are interconnected together by an elongated cross member.

5. The garment hanger of claim 1 which is comprised of molded plastic.

6. The garment hanger of claim 5 wherein at least portions of said molded plastic are tubular.

7. The garment hanger of claim 1 which is comprised of metal.

8. The garment hanger of claim 7 wherein said metal is preformed and wire-like before being formed into said hanger.

9. The garment hanger of claim 8 wherein said metal is tubular.

10. The garment hanger of claim 1 wherein said suspending means comprises a hook means.

11. The garment hanger of claim 1 wherein said suspending means comprises a ring means adapted for slidable extension over exterior circumferential surface portions of a clothes hanger rod.

12. The garment hanger of claim 1 wherein surface portions of said support means are provided with friction enhancing means for retarding sliding movement of garment portions contacting said friction enhancing means.

13. The garment hanger of claim 1 which is associated with a garment that is hung thereon.

14. The garment hanger of claim 1 wherein each said outer end is transversely flattened so as to provided a broadened surface for garment shoulder support.

15. The garment hanger of claim 1 wherein each said arm means if thickened along its length so as to provide a broadened surface for garment shoulder support.

16. A method for mounting a garment having a neck region and opposed shoulder portions upon a garment hanger, said method comprising the successive steps of:

(a) providing the garment hanger described in claim 1 and inserting said one arm means through said neck and into said garment until said lower leg portion is at least approximately adjacent to said neck region;

(b) tilting said hanger laterally relative to said garment while slipping said other arm means through said neck region whereby both of said arm means are in said garment while said suspending means remains outside but adjacent to said neck; and (c) orienting said hanger so that each one of said arm means is interiorly adjacent to a different respective one of said shoulder portions;

whereby said garment hangs from said hanger when said hanger is suspended by said suspending means.

17. The method of claim 16 wherein, in said step (a), said hanger is initially oriented generally horizontally and initially said garment is supported at its neck region with its longitudinal medial axis hanging vertically.

18. The method of claim 16 wherein, in said step (a), said hanger is initially oriented generally perpendicularly relative to the longitudinal medial axis of said garment.

19. An improved garment hanger comprising:

two elongated arm means, each one for supporting a different opposed shoulder of a garment, each one having an outer end and an inner end, each one generally oppositely and downwardly extending relative to one another and to a mid-region therebetween, each said inner end meeting the other at an apex location which is offset from said mid-region;

suspending means for hanging said arm means from a common superior location so that said arm means are in a generally symmetrical, balanced relationship relative to one another and to said mid-region, said suspending means having an associated depending elongated connecting leg whose lower end terminates at said apex location;

connecting means for joining together both said inner ends and said lower end; and said elongated connecting leg having a medial angled knee and a lower leg portion that extends between said knee and said lower end, said lower leg portion having an inclined orientation such that said lower leg portion defines an extension of one of said arm means commencing at said apex location, the other of said arm means having defined therein across said mid-region and adjacent to said apex location a generally J-configured inset which is generally below said lower leg portion, thereby providing in cooperation with said lower leg portion and said apex location a laterally extending intrusion in said hanger that extends below said angled knee whereby said intrusion provides a receiving channel so that the unobstructed perimeter distance along said other arm means from said outer end thereof extends substantially past said mid-region;

whereby, when said other arm means is inserted into the neck region of a necked garment, said other arm means is advanceable through said neck region past said mid-region until said neck region is in adjacent relationship to said lower leg portion.

20. The garment hanger of claim 19 which is generally planar in spatial configuration.

21. The garment hanger of claim 20 wherein the said respective outer ends are interconnected together by an elongated cross member.

22. The garment hanger of claim 19 wherein said suspending means comprises a hook means.

23. The garment hanger of claim 19 which is associated with a garment that is hung thereon.

24. A method for mounting a garment having a neck region and opposed shoulder portions, said method comprising the successive steps of:

(a) providing the garment hanger of claim 26 with said hanger being oriented generally horizontally relative to the longitudinal axis of said garment when suspended from said neck region, inserting said other arm means through said neck and into said garment until said lower leg portion is approximately adjacent to said neck region;

(b) tilting said hanger laterally relative to said garment while slipping said other arm means through said neck region whereby both of said arm means are in said garment while said suspending means remains outside but adjacent to said neck; and (c) orienting said hanger so that each one of said arm means is interiorly adjacent to a different respective one of said shoulder portions;

whereby said garment hangs from said hanger when said hanger is suspended by said suspending means.

* * * * *